US007973813B2

(12) United States Patent
Sakuta

(10) Patent No.: US 7,973,813 B2
(45) Date of Patent: Jul. 5, 2011

(54) THERMAL TRANSFER PRINTER AND METHOD OF REMOVING INK CASSETTE

(75) Inventor: Akira Sakuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 111 days.

(21) Appl. No.: 12/556,799

(22) Filed: Sep. 10, 2009

(65) Prior Publication Data

US 2010/0208023 A1 Aug. 19, 2010

(30) Foreign Application Priority Data

Feb. 18, 2009 (JP) ..... 2009-035034

(51) Int. Cl.
*B41J 23/00* (2006.01)
*B41J 25/304* (2006.01)

(52) U.S. Cl. ..... 347/197

(58) Field of Classification Search ..... 347/197; 400/120.16

See application file for complete search history.

(56) References Cited

U.S. PATENT DOCUMENTS

| | | | | |
|---|---|---|---|---|
| 5,440,328 | A * | 8/1995 | Nardone et al. | 347/173 |
| 5,528,277 | A * | 6/1996 | Nardone et al. | 347/198 |
| 5,546,115 | A * | 8/1996 | Nardone et al. | 347/214 |
| 5,546,116 | A * | 8/1996 | Nardone et al. | 347/218 |
| 6,285,387 | B1 | 9/2001 | Ueno et al. | |
| 6,682,241 | B2 * | 1/2004 | Coons et al. | 400/692 |
| 6,744,455 | B2 * | 6/2004 | Coons et al. | 347/189 |
| 2005/0179764 | A1 | 8/2005 | Goff et al. | |

FOREIGN PATENT DOCUMENTS

| | | |
|---|---|---|
| EP | 0 294 792 | 12/1988 |
| JP | 3444669 B2 | 9/2003 |

* cited by examiner

*Primary Examiner* — Huan H Tran

(74) *Attorney, Agent, or Firm* — Birch, Stewart, Kolasch & Birch, LLP

(57) ABSTRACT

A thermal transfer printer according to the present invention includes; a head mounting base with a thermal head attached thereto, and disposed so as to oppose a platen roller, a locomotion board including a supporting system for supporting the head mounting base so as to be spaced apart from and approaching to the platen roller, and being movable in an extending direction of the thermal head, a slider provided in connection with the supporting system, and being movable in the extending direction of the thermal head, wherein the head mounting base is spaced apart from and approaching to the platen roller by the supporting system as the slider moves.

8 Claims, 17 Drawing Sheets

THERMAL TRANSFER PRINTER AND METHOD OF REMOVING INK CASSETTE

BACKGROUND OF THE INVENTION

1. Field of the Invention

The present invention relates to a thermal transfer printer, and particularly to a thermal transfer printer characterized in a surrounding structure of a thermal head, and a method of removing an ink cassette.

2. Description of the Background Art

A conventional thermal transfer printer has a problem that an ink cassette easily interferes with a thermal head when the ink cassette with an ink sheet roll housed therein is mounted or removed in a longitudinal direction of the thermal head.

As a countermeasure to such a problem, Japanese Patent No. 3444669, for example, discloses a thermal transfer printer including a pressure welding and releasing system provided in a platen roller and a thermal head attached to a base, for facilitating the exchange of an ink cassette by employing a configuration of being rotatable with one end of a head mounting body consisted of the base and an upper cover as a fulcrum, or being movable in parallel.

The thermal transfer printer needs a regular cleaning since a lubricant agent or the like applied on a back surface of an ink sheet is accumulated on the thermal head by repeatedly printing. Further, it is necessary to exchange the thermal head when a heating element on the thermal head is damaged by progression of a thermal head wearing and by foreign materials entering on the thermal head. Particularly, while an industrial thermal transfer printer printing in large amounts often cleans and exchanges the thermal head, the thermal head of the thermal transfer printer disclosed in Japanese Patent No. 3444669 is housed inside a device, so that it is difficult to clean and exchange the thermal head, making it more troublesome.

Since the thermal transfer printer in Japanese Patent No. 3444669 is configured to be rotatable with one end of the thermal head mounting body as a fulcrum, a thermal head part is exposed when the thermal head mounting body is widely rotated. As a result, the problem arises that the exposed thermal head part is damaged by making contact with the ink cassette when exchanging the ink cassette, or an user who has touched the high-temperature thermal head suffers burns.

SUMMARY OF THE INVENTION

It is an object of the present invention to provide a thermal transfer printer capable of exchanging an ink cassette without interfering with a thermal head, and easily cleaning and exchanging the thermal head.

A thermal transfer printer according to the present invention comprises; a head mounting base with a thermal head attached thereto, and disposed so as to oppose a platen roller, a locomotion board including a supporting system for supporting the head mounting base so as to be spaced apart from and approaching to the platen roller, and being movable in an extending direction of the thermal head; a slider provided in correction with the supporting system, and being movable in the extending direction of the thermal head, wherein the head mounting base is spaced apart from and approaching to the platen roller by the supporting system as the slider moves.

The thermal transfer printer according to the present invention can easily exchange an ink cassette without interfering with a thermal head, clean and exchange the thermal head by including a head mounting base with a thermal head attached thereto, and disposed so as to oppose a platen roller, a first locomotion system including a supporting system for supporting the head mounting base so as to be spaced apart from and approaching to the platen roller, and being movable in an extending direction of the thermal head; a second locomotion system provided in connection with the supporting system, and being movable in the extending direction of the thermal head, wherein the head mounting base is spaced apart from and approaching to the platen roller by the supporting system as the second locomotion system moves.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
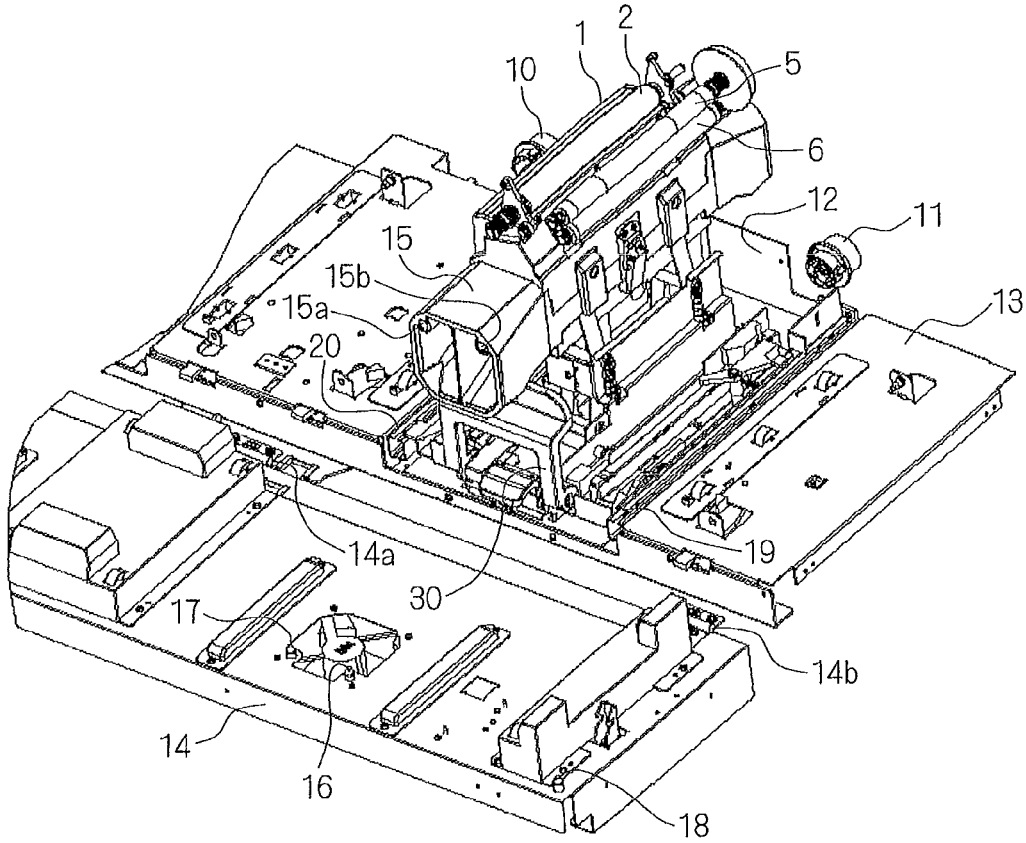
FIG. 1 is a perspective view of a surrounding structure of a thermal head according to the first preferred embodiment of the present invention.

The preferred embodiments of the present invention will be described referring to the drawings.

First, a technique to be the premise of the present invention will be described.

Figure 17:
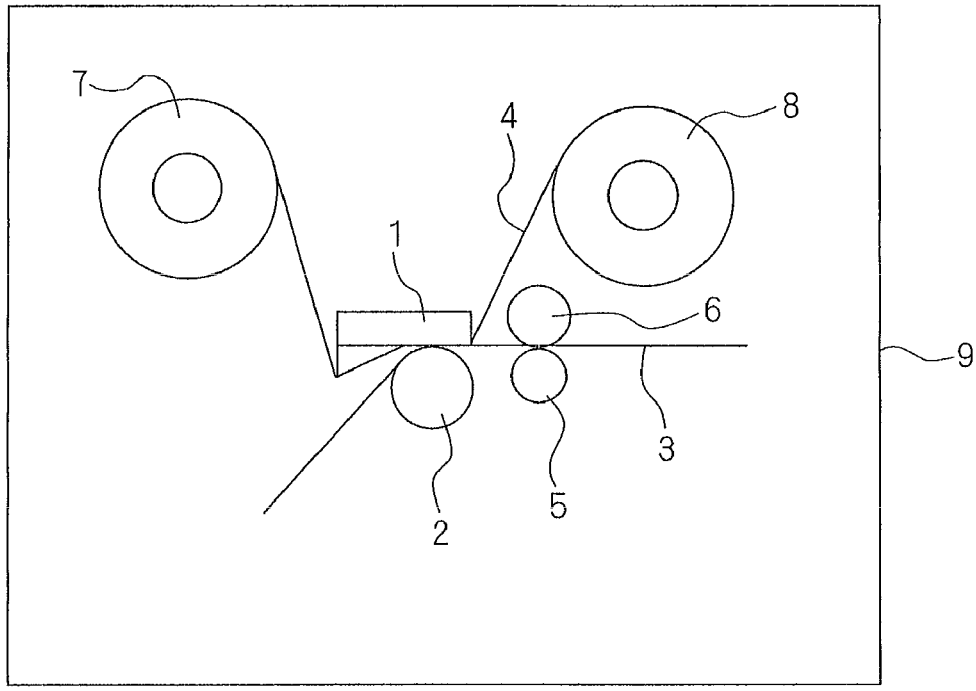
FIG. 17 is a structural diagram of a conventional thermal transfer printer.

FIG. 17 is a structural diagram of a conventional thermal transfer printer. As shown in FIG. 17, a main body 9 of a conventional thermal transfer printer comprises a thermal head 1 including a plurality of heating elements, a platen roller 2 disposed so as to oppose to the thermal head 1, a paper 3 which is a print medium for forming an image and disposed between the thermal head 1 and the platen roller 2, an ink sheet 4 to which dye or pigment is applied, a grip roller 5 disposed on a back surface of the paper 3 and including high ability of transferring the paper 3 by providing tiny protrusions on its surface, a pinch roller 6 disposed so as to oppose the grip roller 5, an ink sheet roll 7 at the supply side with the ink sheet 4 wound around, and an ink sheet roll 8 at the rewind side for rewinding the ink sheet 4.

The aforementioned thermal transfer printer transfers dye or pigment applied on the ink sheet 4 to the paper 3 in printing by selectively heating the heating elements of the thermal head 1 with the ink sheet 4 supplied from the ink sheet roll 7 at the supply side and the paper 3 interposed and crimped between the thermal head 1 and the platen roller 2. The printed paper 3 is placed between the grip roller 5 and the pinch roller 6, and a rotative driving power of the grip roller 5 is transferred to the paper 3 by pushing the pinch roller 6 to the grip roller 5. The printed ink sheet 4 is rewound around the ink sheet roll 8 at the rewind side.

However, the conventional thermal transfer printer had a problem that the ink cassette and the thermal head easily interfere with each other when mounting and removing the ink cassette with the ink sheet roll housed therein in a longitudinal direction of the thermal head. The aforementioned problem was also seen in Japanese Patent No. 3444669.

The present invention has been made to solve the above problems, and will be described in detail hereinafter.

First Preferred Embodiment

FIG. 1 is a perspective view of a surrounding structure of a thermal head 1 when an ink cassette 23 (FIG. 3) is not shown according to the first preferred embodiment of the present invention. As shown in FIG. 1, the thermal transfer printer according to the first preferred embodiment includes a head mounting base 15 with the thermal head 1 attached thereto, and disposed so as to oppose a platen roller 2, a locomotion board 12 (first locomotion system) including a supporting system for supporting the head mounting base 15 so as to be spaced apart from and approaching to the platen roller 2, and being movable in an extending direction of the thermal head 1, a slider 24 (second locomotion system) (FIG. 4) provided in connection with the supporting system, and being movable in the extending direction of the thermal head 1, where the head mounting base 15 is spaced apart from and approaching to the platen roller 2 by the supporting system as the slider 24 moves. The head mounting base 15 is formed of high thermal conductive materials such as aluminum for cooling down the thermal head 1. The supporting system will be later described in detail.

The thermal transfer printer according to the first preferred embodiment further comprises; an ink reel spindle 10 at the supply side connected to a torque control system (not shown) and a lock system (not shown) provided at a side of a base 13 (printer main body), and engaged with an ink sheet roll at the supply side (not shown), an ink reel spindle 11 at the rewind side connected to a rewinding system (not shown) and a lock system (not shown) provided at the side of the base 13, and engaged with an ink sheet roll at the rewind side (not shown), a door 14 being rotatable with hinges 14*a* and 14*b* as fulcrums (the door 14 shown in the Figure is in an open state), positioning pins A 16 and 17 at the door provided at the door 14 so as to be engaged with each of engagement parts 15*a* and 15*b* provided in the head mounting base 15 and control the position and posture of the thermal head 1, a positioning pin C 18 provided on the same plane as the positioning pins A 16 and 17 at the door 14 so as to be engaged with the base 13, and first guiding members 19 and 20 placed between the locomotion board 12 and the base 13, for guiding and supporting the locomotion board 12 to be movable in one direction to the base 13. The positioning pin C 18 is also provided at the other end of the door 14 in the longitudinal direction, but is omitted to be shown in the Figure.

Figure 2:
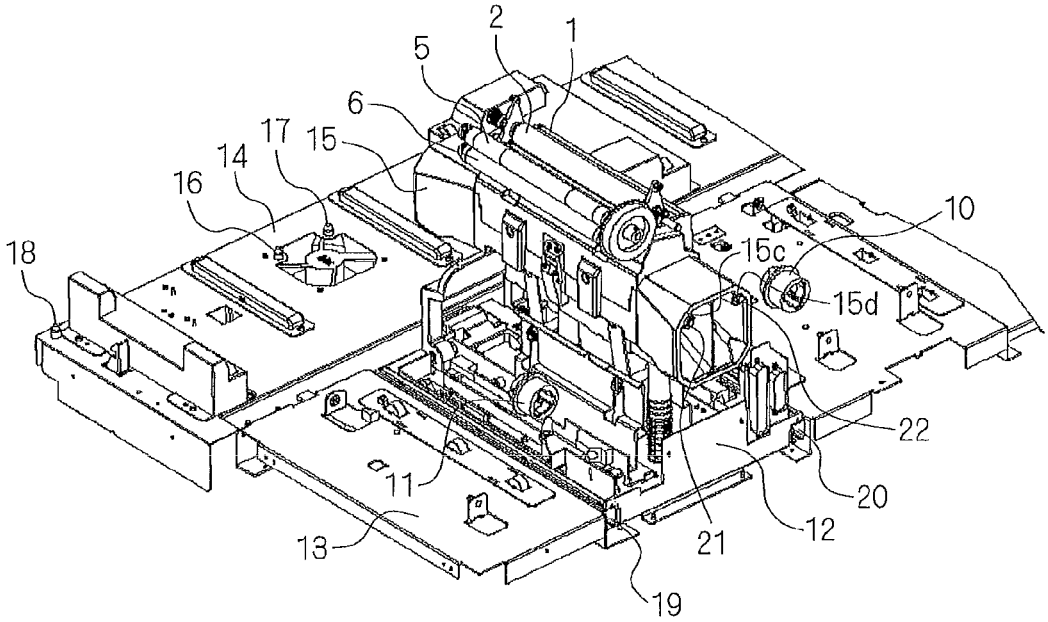
FIG. 2 is a perspective view of the surrounding structure of the thermal head according to the first preferred embodiment of the present invention.

FIG. 2 is a perspective view of the surrounding structure of the thermal head 1 according to the first preferred embodiment of the present invention. FIG. 2 is a view of the surrounding structure of the thermal head 1 shown in FIG. 1 seen from backward. As shown in FIG. 2, the engagement parts 15*c* and 15*d* are formed in the head mounting base 15, and positioning pins B 21 and 22 are provided at the side of the base 13 so as to be engaged with each of the engagement parts 15*c* and 15*d* and control the position and posture of the thermal head 1.

Figure 3:
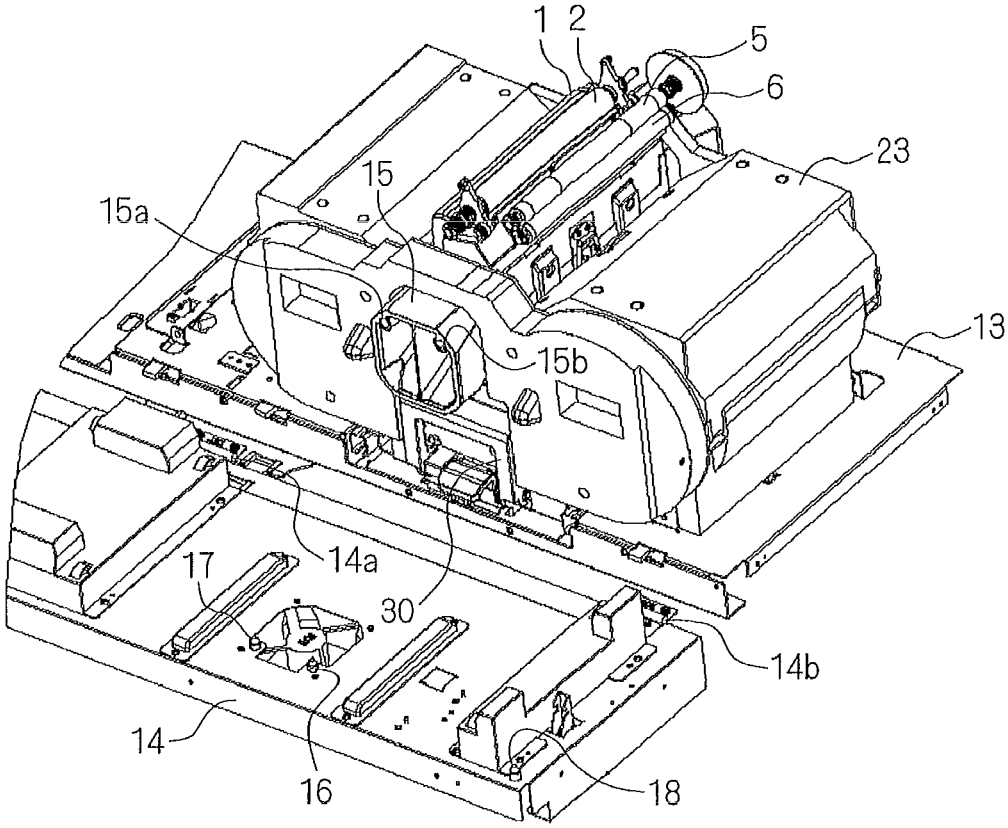
FIG. 3 is a perspective view of the surrounding structure of the thermal head with an ink cassette mounted thereon according to the first preferred embodiment of the present invention.

FIG. 3 is a perspective view of the surrounding structure of the thermal head 1 with the ink cassette 23 mounted thereon according to the first preferred embodiment of the present invention. As shown in FIG. 3, the thermal transfer printer according to the present embodiment further comprises an ink cassette to be removable, striding over the head mounting base 15, for supplying an ink sheet. The ink cassette 23 houses an ink sheet roll at the supply side and an ink sheet roll at the rewind side. The present embodiment employs a method of pressing the platen roller 2 to the thermal head 1 in a state where the thermal head 1 is located below the platen roller 2, as a method of crimping an ink sheet and a paper.

Figure 4:
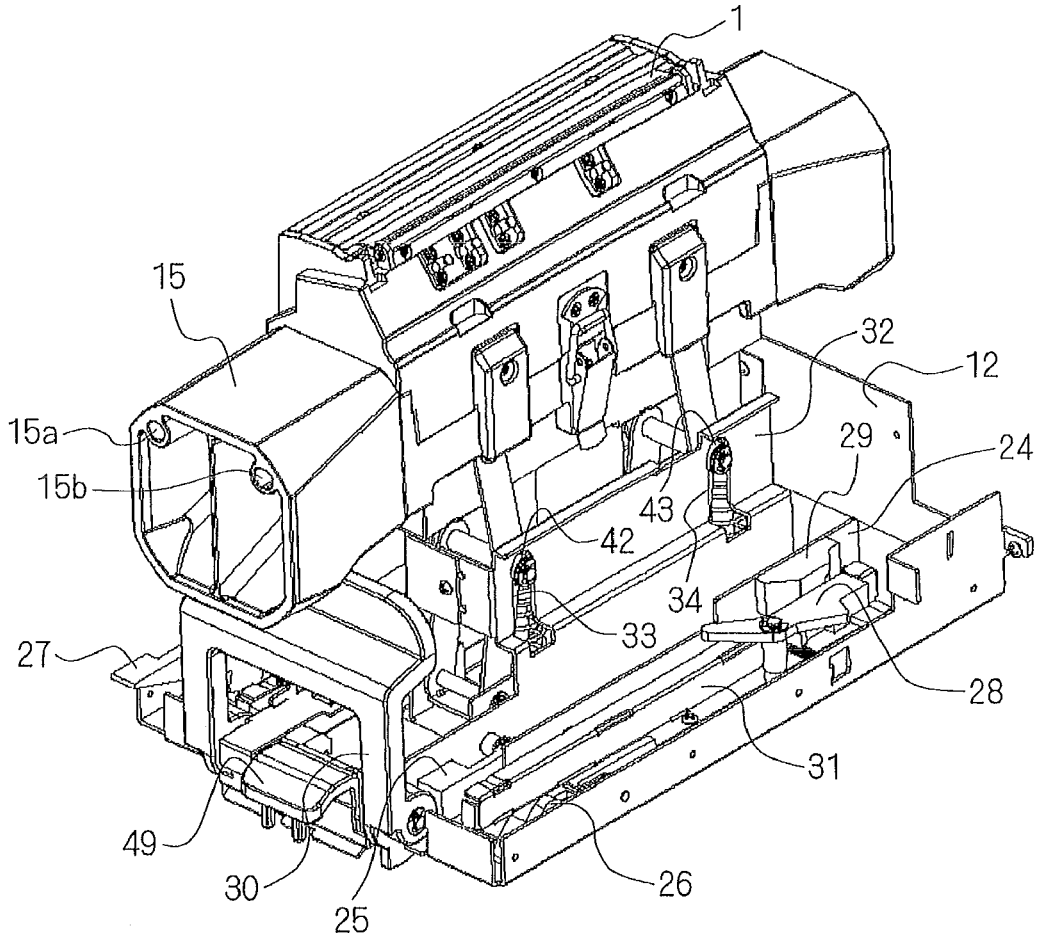
FIG. 4 is a perspective view of the detail of the surrounding structure of the thermal head according to the first preferred embodiment of the present invention.
Figure 5:
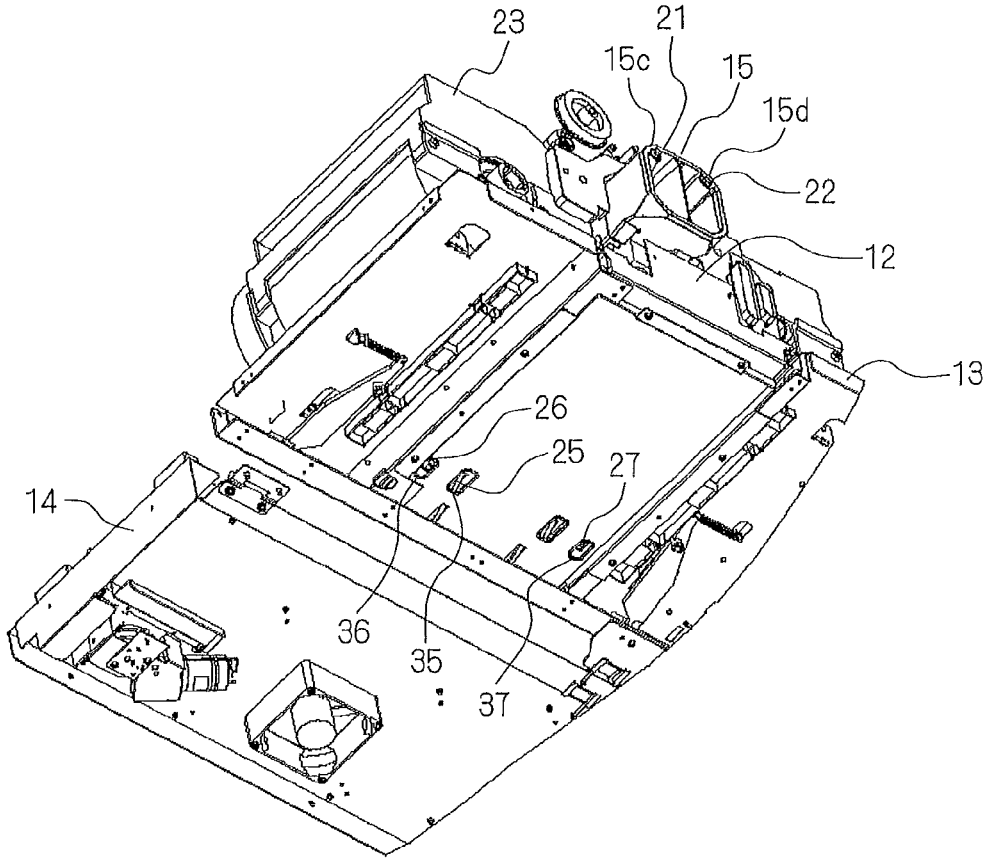
FIG. 5 is a perspective view of the surrounding structure of the thermal head seen from below according to the first preferred embodiment of the present invention.

FIG. 4 is a perspective view of the detail of the surrounding structure of the thermal head 1 according to the first preferred embodiment of the present invention. FIG. 5 is a perspective view of the surrounding structure of the thermal head 1 seen from below according to the first preferred embodiment of the present invention, and a view of the surrounding structure of the thermal head 1 shown FIG. 2 seen from below. As shown in FIGS. 4 and 5, the slider 24 is constituted to be movable in an extending direction of the thermal head 1 to the locomotion board 12, and a first lock lever 25 provided on the locomotion board 12 restricts the movement of the locomotion board 12 by being urged to be engaged with an engagement part 35 of the base 13 with springs (not shown). A second lock lever 26 (third control member) including an abutting part with the ink cassette 23, is urged to be spaced apart from the base 13 with the springs (not shown), and is urged to be engaged with an engagement part 36 of the base 13 by the abutting part making contact with the ink cassette 23 so as to restrict the movement of the locomotion board 12 when the ink cassette 23 is mounted. That is, the second lock lever 26 restricts the movement of the locomotion board 12 in accordance with presence or absence of the ink cassette 23. In the states shown in FIGS. 4 and 5, the second lock lever 26 is not engaged with the engagement part 36. A third lock lever 27 is urged to be engaged with an engagement part 37 of the base 13 with the springs (not shown) so as to restrict the movement of the locomotion board 12. A cassette locking member 28 (first control member) provided on the locomotion board 12 includes an engagement part to be engaged with an engagement part 23*a* (FIG. 12) of the ink cassette 23. That is, the cassette locking part 28 is provided on the locomotion board 12 and restricts the movement of the ink cassette 23. An abutting member 29 (second control member) is provided on the slider 24 so as to come into contact with the cassette locking member 28. That is, the abutting part 29 is provided on the slider 24, and releases the restriction of the cassette locking member 28 in conjunction with the slider 24. A lock releasing lever 30 is attached to the slider 24 to be rotatable, and includes an part to make contact with the first lock lever 25. A second guiding member 31 guides and supports the slider 24 to be movable to the locomotion board 12. A driving plate 32 is provided on the slider 24, and includes engagement trenches 33 and 34. A fourth lock lever 49 restricts the relative movement of the slider 24 and the locomotion board 12.

Figure 6:
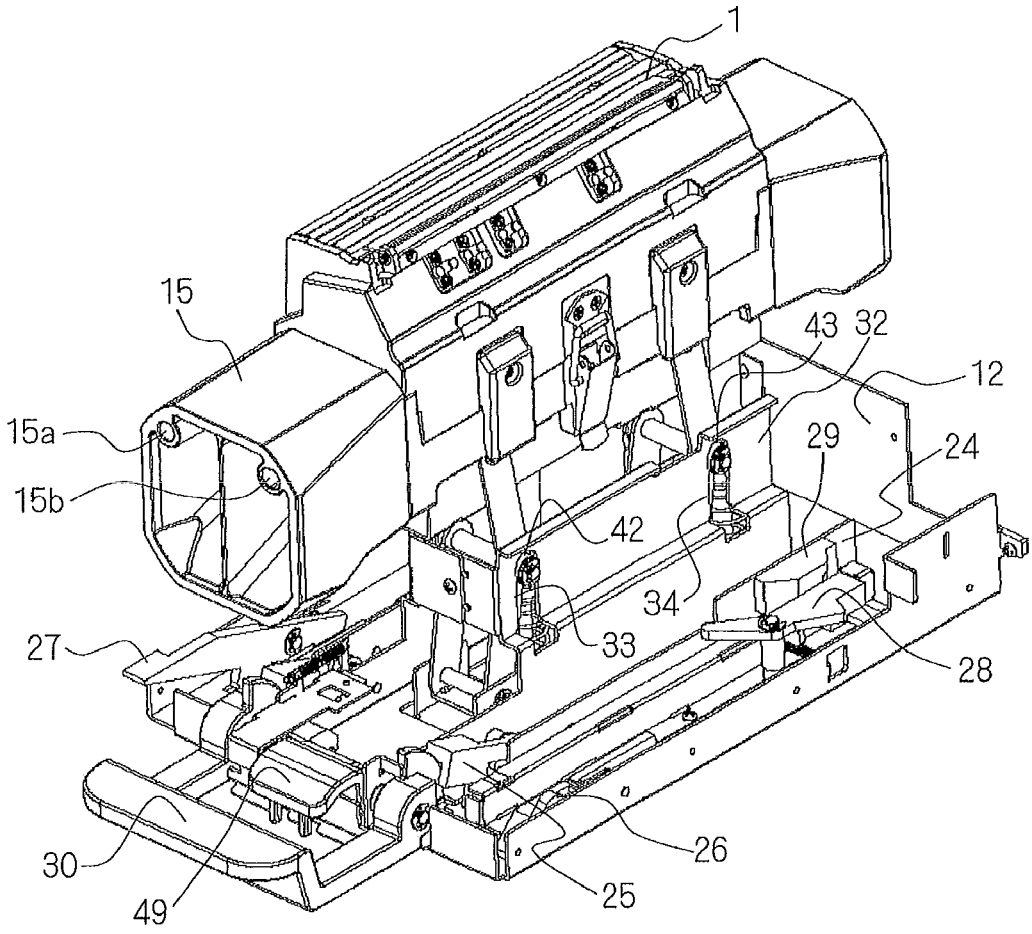
FIG. 6 is a perspective view of the detail of the surrounding structure of the thermal head according to the first preferred embodiment of the present invention.
Figure 7:
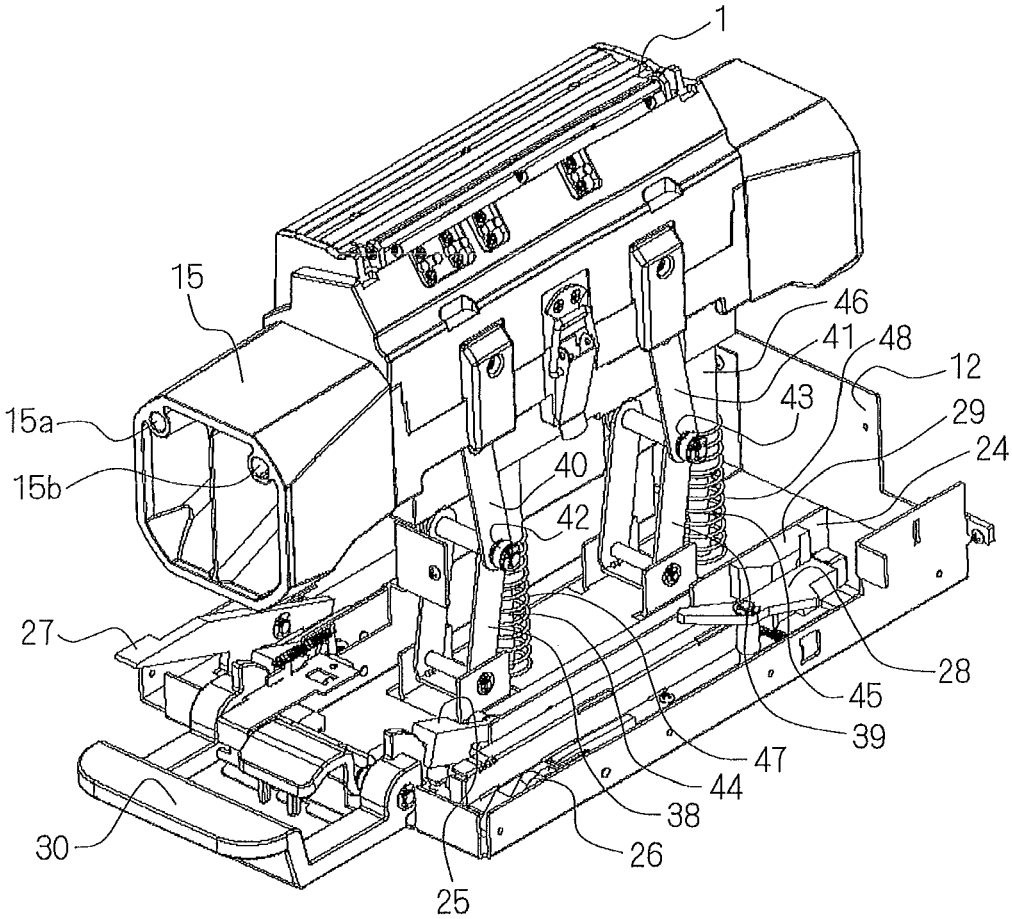
FIG. 7 is a perspective view of the detail of the surrounding structure of the thermal head according to the first preferred embodiment of the present invention.

FIGS. 6 and 7 are perspective views of the detail of the surrounding structure of the thermal head 1 according to the first preferred embodiment of the present invention. FIG. 7 is a view excluding the driving plate 32 shown in FIG. 6, and shows the supporting system for supporting the head mounting base 15 with the thermal head 1 attached thereto to be spaced apart from and approaching to the platen roller 2.

As shown in FIG. 7, the supporting system according to the present embodiment comprises links A 38 and 39 with each one end connected to the locomotion board 12 to be rotatable, links B 40 and 41 with each one end connected to the head mounting base 15 to be rotatable, and the other ends connected to each of the links A 38 and 39, respectively, to be rotatable, rollers 42 and 43 provided in joint parts to be connection parts of each of the links A 38 and 39 and the links B 40 and 41, linear motion guides 44 and 45 placed on the locomotion board 12 so as to perform an operation of spacing apart and approaching the head mounting base 15 while maintaining the head mounting base 15 to be horizontal to the locomotion board 12, a guide holder 46 placed on the head mounting base 15 so as to be engaged with each of the linear motion guides 44 and 45, and movable along the linear motion guides 44 and 45, and compression springs 47 and 48 for adding force to a direction of pushing up the head mounting base 15 so as to assist the movement of the head mounting base 15 in approaching to the platen roller 2.

Next, the operation of the thermal transfer printer according to the first preferred embodiment will be described.

To begin with, as shown in FIG. 3, the positioning pins A 16 and 17 provided on the door 14 are separated from the engagement parts 15*a* and 15*b*, respectively, by opening the door 14. At the same time, the positioning pin C 18 provided on the door 14 is also separated from an engagement part (not shown) provided at the side of the base 13 (side of the printer main body). As shown in FIG. 2, the engagement parts 15*c* and 15*d* provided in the head mounting base 15 are engaged with the positioning pins B 21 and 22 provided at the side of the base 15, respectively. At this time, as shown in FIG. 5, the first lock lever 25 provided on the locomotion board 12 is engaged with the engagement part 35 provided on the base 13 and restricts the movement of the locomotion board 12. The second lock lever 26 is not engaged with the engagement part 36 provided on the base 13, and the third lock lever 27 is not engaged with the engagement part 37 provided on the base 13. FIG. 1 is shown to exclude the ink cassette 23 shown in FIG. 3, and for the sake of convenience of the explanation, it will be described omitting the ink cassette 23, hereinafter.

Figure 8:
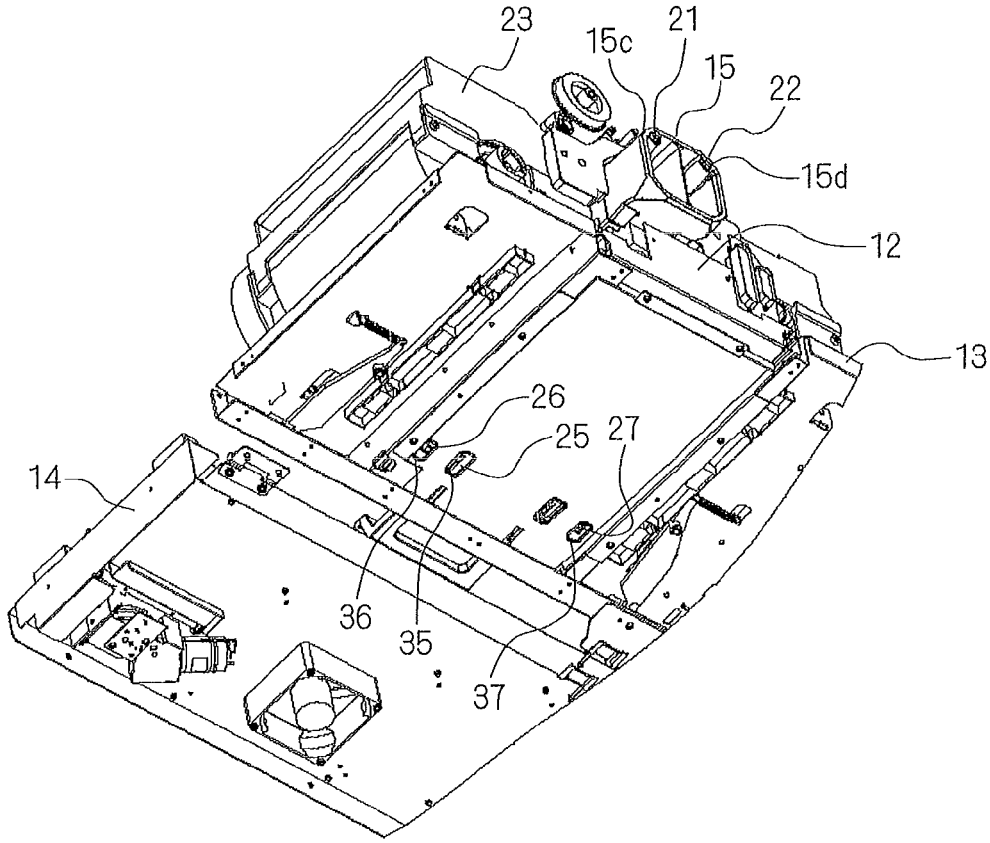
FIG. 8 is a perspective view of the surrounding structure of the thermal head seen from below according to the first preferred embodiment of the present invention.

Next, the lock releasing lever 30 shown in FIG. 4 is rotated, and the first lock lever 25 is pushed up by the abutting part of the lock releasing lever 30 (FIG. 6). The first lock lever 25 is released from the engagement with the engagement part 35 (FIG. 8). At this time, as shown in FIG. 8, the second lock lever 26 is not engaged with the engagement part 36, and the third lock lever 27 is also not engaged with the engagement part 37. Accordingly, the locomotion board 12 comes to be movable to the base 13.

Figure 9:
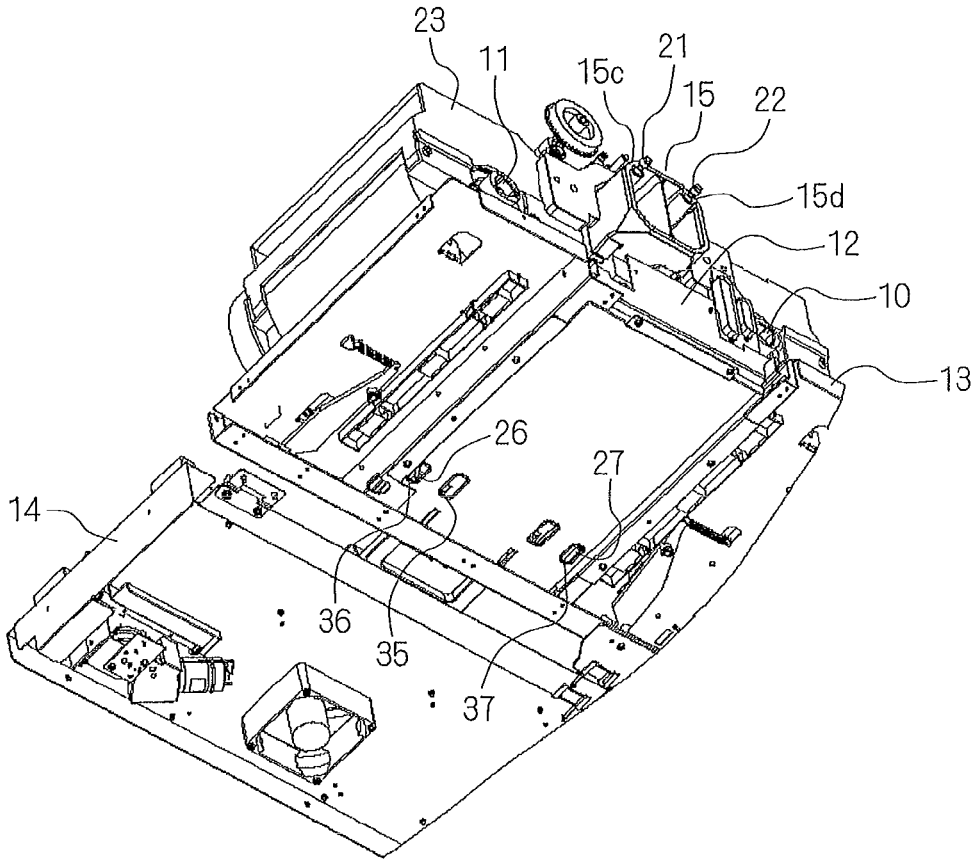
FIG. 9 is a perspective view of the surrounding structure of the thermal head seen from below according to the first preferred embodiment of the present invention.

When the lock releasing lever 30 is extracted after releasing the engagement of the first lock lever 25, the locomotion board 12 and the slider 24 are extracted along the first guiding members 19 and 20 in an integrated manner since the relative movement is restricted by the fourth lock lever 49. When the locomotion board 12 is extracted by the lock releasing lever 30, as shown in FIG. 9, the third lock lever 27 comes to be engaged with the engagement part 37. At the same time, the second lock lever 26 comes to be engaged with the engagement part 36. As a result, the locomotion board 12 is fixed by the base 13 and its movement is restricted. At this time, as shown in FIG. 9, the locomotion board 12 is in a state being slightly extracted, and each of the positioning pins B 21 and 22 comes to be released from the engagement with each of the engagement parts 15*c* and 15*d*. Also, each of the ink reel spindle 10 at the supply side and the ink reel spindle 11 at the rewind side comes to be released from the engagement with the ink sheet rolls in the ink cassette 23.

The slider 24 comes to be relatively movable to the locomotion board 12 by releasing the fourth lock lever 49 after restricting the movement of the locomotion board 12 by engaging the third lock lever 27 with the engagement part 37. When the lock releasing lever 30 is extracted in this state, only the slider 24 is extracted along the second guiding member 31 since the movement of the locomotion board 12 is restricted by the third lock lever 27. As shown in FIG. 6, as the slider 24 moves, the driving plate 32 constituted to be integrated with the slider 24 also moves, and the rollers 42 and 43 engaged with each of the engagement trenches 33 and 34 formed in the driving plate 32 are driven to rotate.

As shown in FIG. 7, each one end of the links A 38 and 39 is connected to the locomotion board 12 to be rotatable, and each of the other ends is connected to the links B 40 and 41 to be rotatable, and each one end of the links B 40 and 41 is connected to the head mounting base 15 to be rotatable. The rollers 42 and 43 engaged with each of the engagement trenches 33 and 34 are provided in the joint parts of each of the links A 38 and 39 and each of the links B 40 and 41. As described above, in the present embodiment, a toggle linkage system is constituted among the head mounting base 15, the locomotion board 12, and the slider 24. The head mounting base 15 is held by the linear motion guides 44 and 45 and the guide holder 46.

Figure 10:
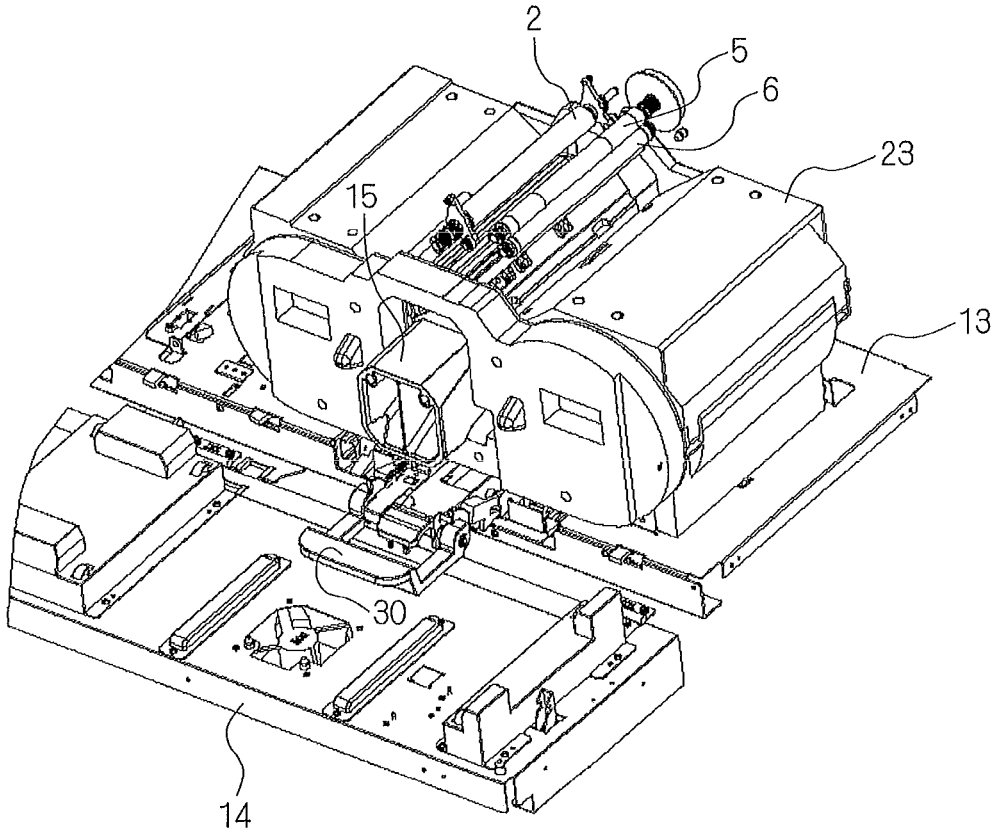
FIG. 10 is a perspective view of the surrounding structure of the thermal head with an ink cassette mounted thereon according to the first preferred embodiment of the present invention.
Figure 11:
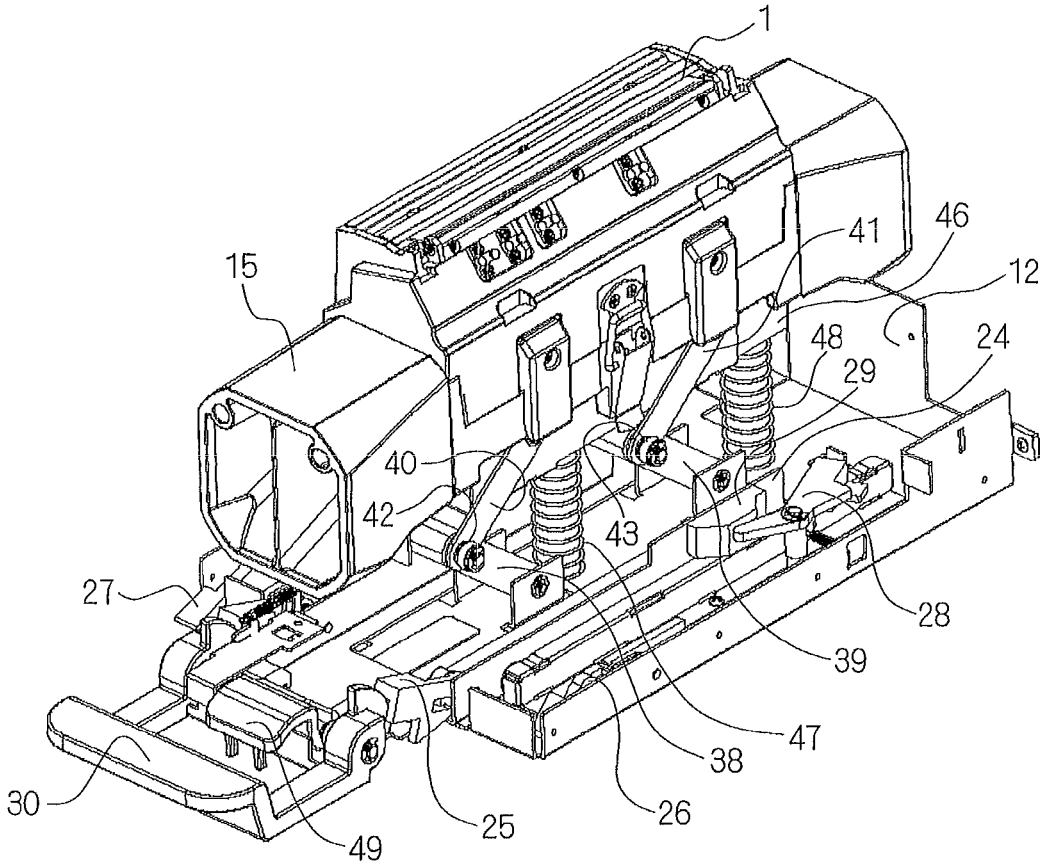
FIG. 11 is a perspective view of the detail of the surrounding structure of the thermal head according to the first preferred embodiment of the present invention.

When the slider 24 is extracted, the rollers 42 and 43 engaged with each of the engagement trenches 33 and 34 are driven to rotate, and the links A 38 and 39 and the links B 40 and 41 are flexed with the rollers 42 and 43 to be the joint parts as the centers, and the head mounting base 15 descends along the linear motion guides 44 and 45 (FIG. 11). Accordingly, the head mounting base 15 is moved by the toggle linkage system in a direction perpendicular to the locomotion board 12, so that the position of the thermal head 1 can be lowered to the position so as not to interfere when mounting and removing the ink cassette 23 (FIG. 10).

Figure 12:
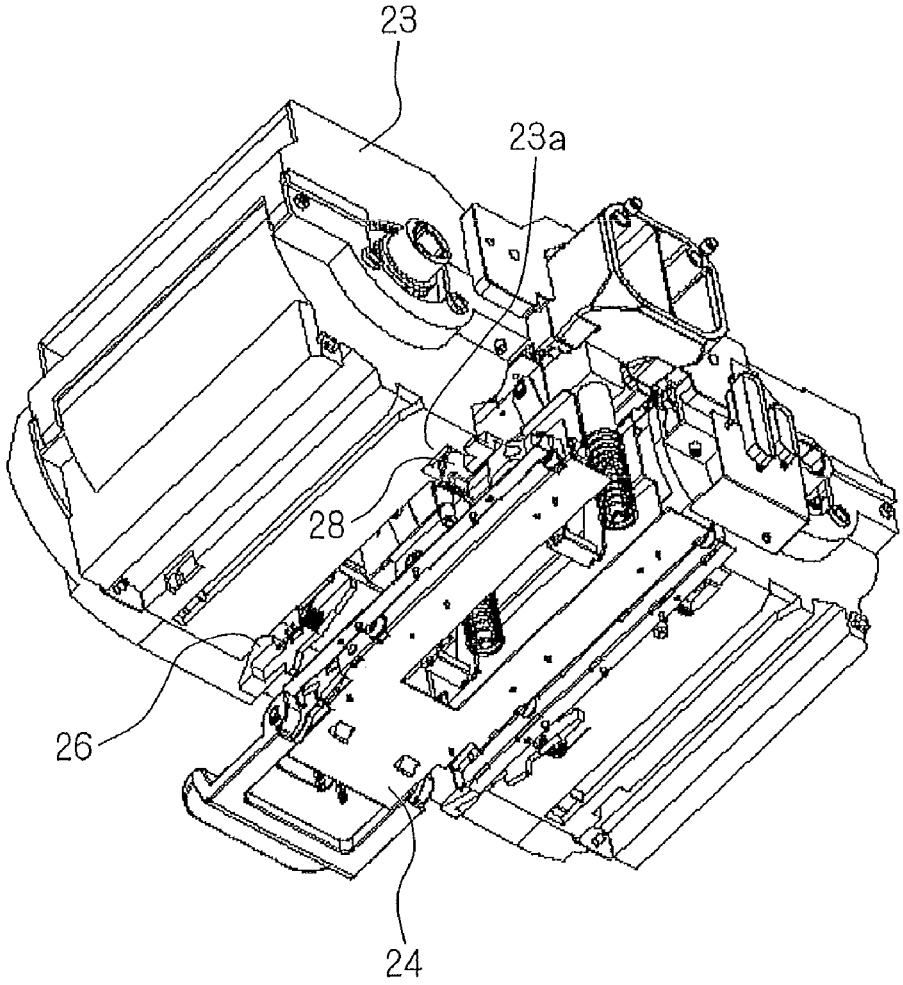
FIG. 12 is a perspective view of the surrounding structure of the thermal head with an ink cassette mounted thereon seen from below according to the first preferred embodiment of the present invention.
Figure 13:
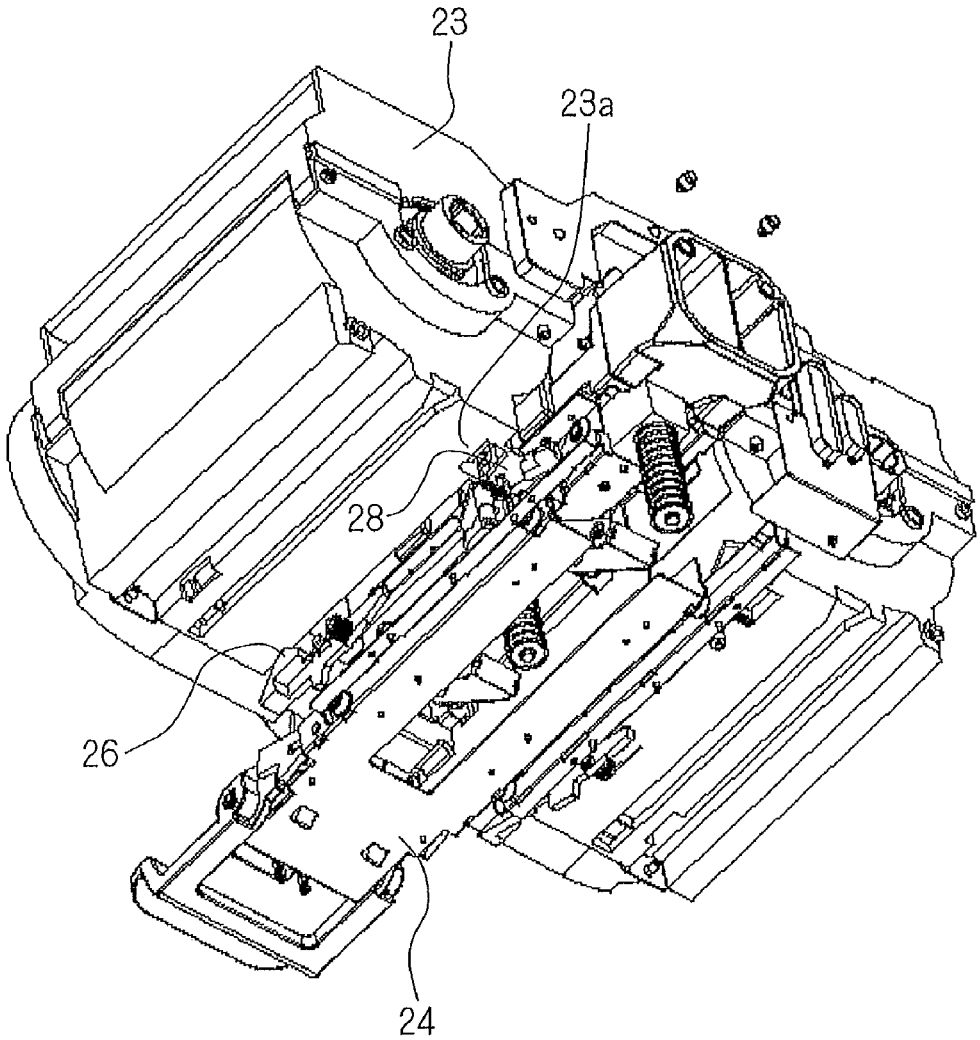
FIG. 13 is a perspective view of the surrounding structure of the thermal head with an ink cassette mounted thereon seen from below according to the first preferred embodiment of the present invention.

FIG. 12 is a perspective view of the surrounding structure of the thermal head 1 with the ink cassette 23 mounted thereon seen from below according to the first preferred embodiment of the present invention. FIG. 12 is a view excluding the locomotion board 12 and the base 13 shown in FIG. 9, and shows a state where the head mounting base 15 is approaching to the platen roller 2. As shown in FIG. 12, the cassette locking member 28 provided on the locomotion board 12 is engaged with an engagement part 23*a* provided in the ink cassette 23, and restricts the movement of the ink cassette 23. When the slider 24 relatively moves to the locomotion board 12, the abutting member 29 provided on the slider 24 comes into contact with the cassette locking member 38 to rotate the cassette locking member 28. The engagement of the ink cassette 23 with the engagement part 23*a* is released by rotating the cassette locking member 28, enabling the ink cassette 23 to move (FIGS. 11 and 13), and exchanging the ink cassette 23 as needed. These sequential operations are performed simultaneously as the head mounting base 15 descends.

Figure 14:
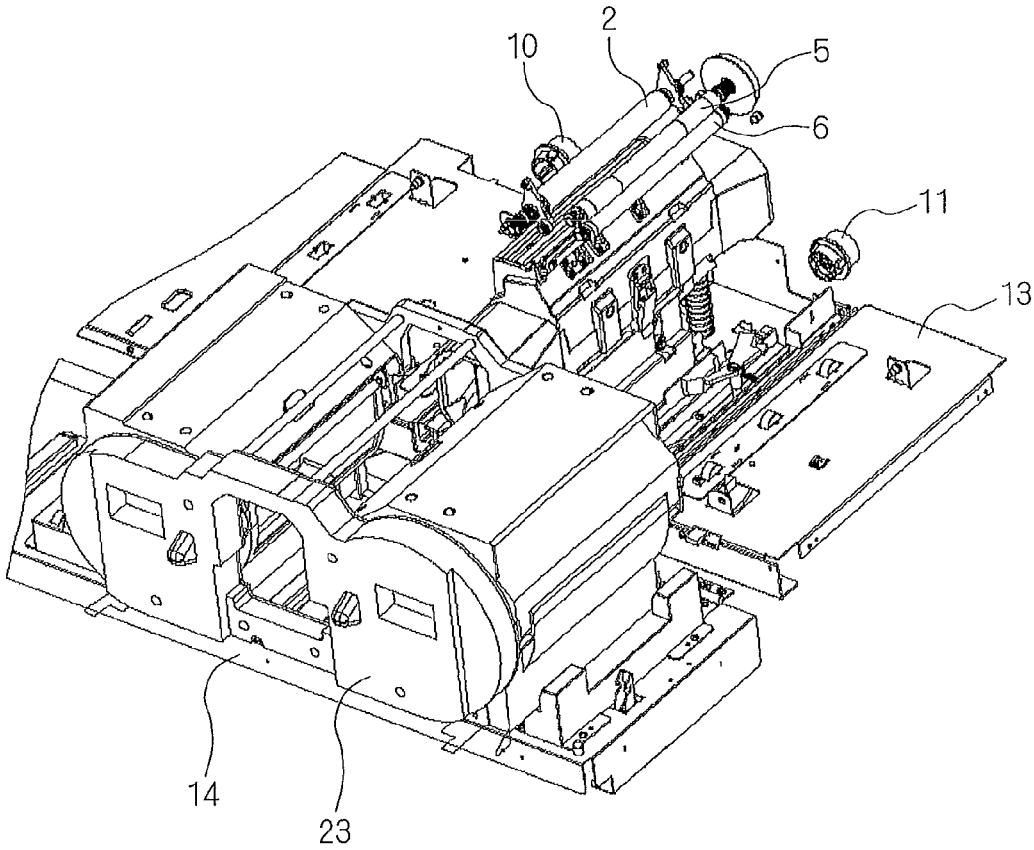
FIG. 14 is a perspective view of a surrounding structure of a thermal head according to the first preferred embodiment of the present invention.
Figure 15:
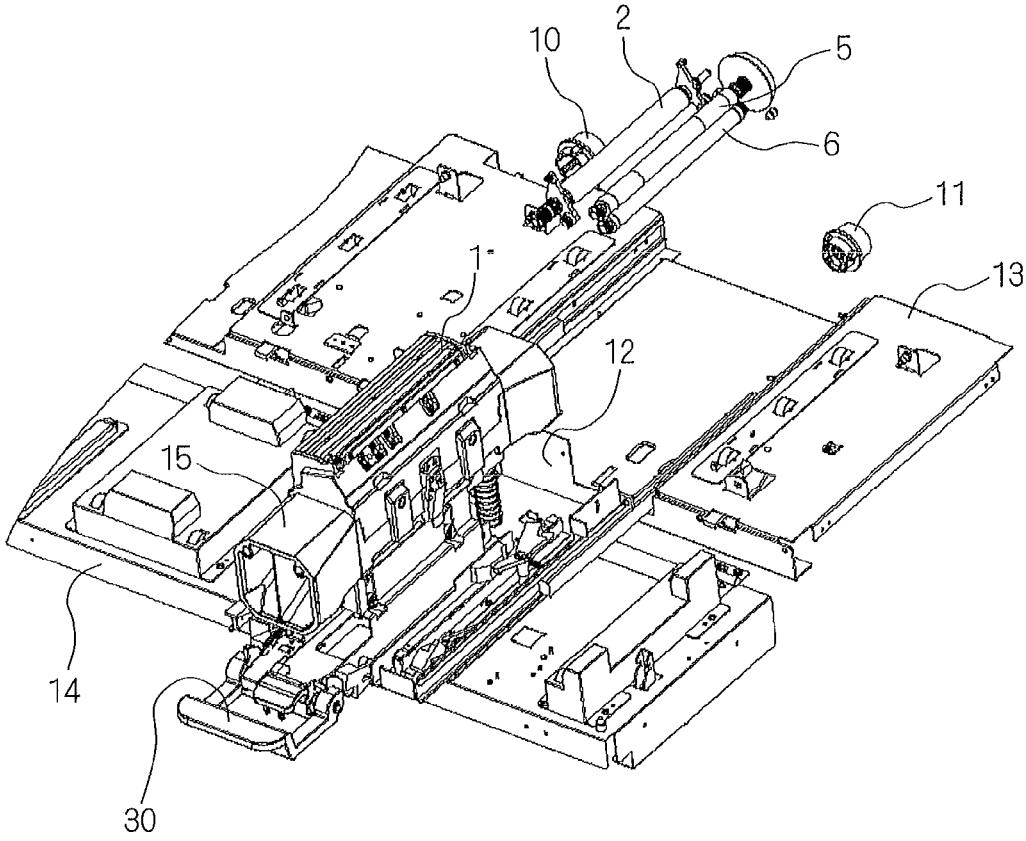
FIG. 15 is a perspective view of a surrounding structure of a thermal head according to the first preferred embodiment of the present invention.

FIG. 14 is a perspective view of the surrounding structure of the thermal head 1 according to the first preferred embodiment of the present invention. As shown in FIG. 14, when the ink cassette 23 is extracted, the engagement of the second lock lever 26 with the engagement part 36 is released. When the lock releasing lever 30 is further extracted by releasing the engagement of the third lock lever 27 with the engagement part 37 after the ink cassette 23 is removed, the locomotion board 12 and the head mounting base 15 are extracted together so that the thermal head 1 is exposed (FIG. 15), allowing the exchange and the cleaning of the thermal head 1 as needed. That is, the locomotion board 12 is further moved after removing the ink cassette 23 to extract the head mounting base 15 to the position outside the printer main body. The second lock lever 26 is urged to be engaged with the engagement part 36 while the ink cassette 23 is mounted, so that the locomotion board 12 cannot be extracted even by releasing the engagement of the third lock lever 27 with the engagement part 37 while the ink cassette 23 is mounted.

The mounting of the ink cassette 23 will be described. The ink cassette 23 is mounted by performing the procedure inversely with the procedure of removing the ink cassette 23 described above. Firstly, the ink cassette 23 is mounted after housing the head mounting base 15 to the base 13. Then, as the slider 24 is moved by pressing the lock releasing lever 30, the head mounting base 15 is moved to the position to approach to the platen roller 2. The ascending of the head mounting base 15 is assisted by the compression springs 47 and 48 pushing up the guide holder 46 provided on the head mounting base 15 when the lock releasing lever 30 is pressed, so that the force of pressing the lock releasing lever 30 can be reduced. While the supplementary power of the compression springs 47 and 48 is lowered as the head mounting base 15 ascends, the toggle linkage system is constituted as the supporting system for supporting the head mounting base 15 to be spaced apart from and approaching to the platen roller 2 in the present embodiment, so that the component force of the links A 38 and 39 and the links B 40 and 41 to the direction of the platen roller 2 increases, and the force imposed on each link by pressing the lock releasing lever 30 is equalized. Further, the links A 38 and 39 and the links B 40 and 41 come into contact with a stopper (not shown) after exceeding a top dead center, preventing the head mounting base 15 from descending due to its own weight.

From the above, the ink cassette 23 can be removable after spacing apart the thermal head 1 to the position not interfering with the ink cassette 23, so that the thermal head 1 is not damaged by making contact with the thermal head 1 in exchanging the ink cassette 23. Further, the thermal head 1 is exposed after removing the ink cassette 23, allowing the thermal head 1 to be easily cleaned and exchanged. The head mounting base 15 is fixed to the base 13 and the door 14 by the positioning pins A 16 and 17, the positioning pins B 21 and 22, and the positioning pin C 18, allowing the placement to the thermal transfer printer by positioning with high accuracy.

In the first preferred embodiment, the compression springs 47 and 48 are used for assisting to push up the head mounting base 15 to the direction of the platen roller 2, but the same effect can be expected by using even extension springs or torsional springs if they assist to push up the head mounting base 15 to the direction of the platen roller 2.

Second Preferred Embodiment

Figure 16:
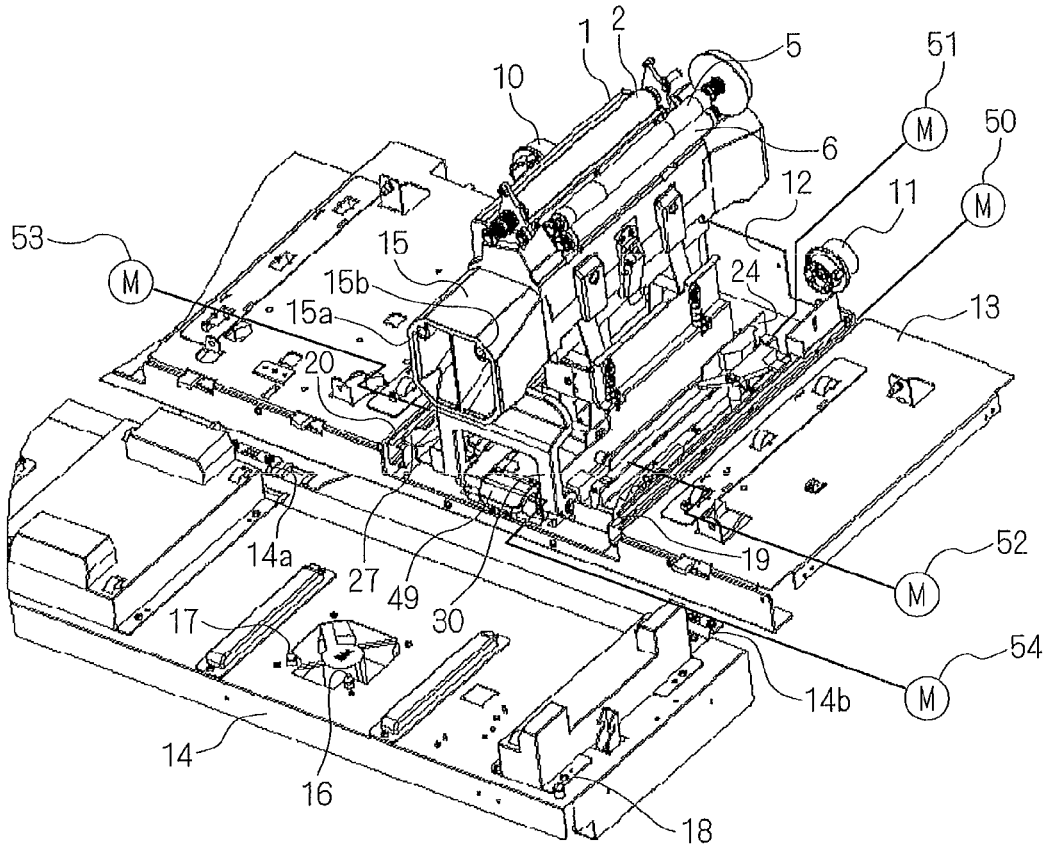
FIG. 16 is a perspective view of a surrounding structure of a thermal head according to the second preferred embodiment of the present invention.

The second preferred embodiment is characterized in that at least one of the locomotion board 12 or the slider 24 is driven by an actuator. FIG. 16 is a perspective view of the surrounding structure of the thermal head 1 according to the second preferred embodiment of the present invention. While the locomotion board 12, the slider 24, the first lock lever 25, the third lock lever 27, and the fourth lock lever 49 are operated by hand in the first preferred embodiment, the second preferred embodiment is characterized in that all or a part of these are driven by the actuator such as a motor or plunger. Other configurations and operations are same as the first preferred embodiment, so that the explanation thereof will be omitted.

As shown in FIG. 16, a motor 50 allows the locomotion board 12 to move along the first guiding members 19 and 20, and a motor 51 allows the slider 24 to move along the second guiding member 31. A motor 52 allows the first lock lever 25 to be engaged with and released from the engagement part 35, and a motor 53 allows the third lock lever 27 to be engaged with and released from the engagement part 37. Furthermore, a motor 54 allows the fourth lock lever 49 to be engaged with and released from the locomotion board 12.

From the above, in addition to the effect of the first preferred embodiment, the effect of further improving usability of the thermal transfer printer can be obtained.

While the invention has been shown and described in detail, the foregoing description is in all aspects illustrative and not restrictive. It is therefore understood that numerous modifications and variations can be devised without departing from the scope of the invention.

What is claimed is:

1. A thermal transfer printer comprising:

a head mounting base with a thermal head attached thereto, and disposed so as to oppose a platen roller;

a first locomotion system including a supporting system for supporting said head mounting base so as to be spaced apart from and approaching to said platen roller, and being movable in an extending direction of said thermal head;

a second locomotion system provided on said first locomotion system in connection with said supporting system, and being movable in the extending direction of said thermal head to said first locomotion system;

wherein said head mounting base is spaced apart from and approaching to said platen roller by said supporting system as said second locomotion system moves.

2. The thermal transfer printer according to claim 1, further comprising, an ink cassette disposed to be removable, striding over said head mounting base, for supplying an ink sheet.

3. The thermal transfer printer according to claim 1, wherein said supporting system includes;

a toggle linkage system for moving said head mounting base in a direction perpendicular to said first locomotion system, and compression springs for adding force to a direction of pushing up said head mounting base.

4. The thermal transfer printer according to claim 2, further comprising, a first control member provided in said first locomotion system, for restricting the movement of said ink cassette.

5. The thermal transfer printer according to claim 4, further comprising, a second control member provided in said second locomotion system, for removing the restriction of said first control member in conjunction with said second locomotion sytem.

6. The thermal transfer printer according to claim 2, further comprising, a third control member for restricting the movement of said first locomotion system in accordance with presence or absence of said ink cassette.

7. The thermal transfer printer according to claim 1, wherein at least one of said first locomotion system or said second locomotion system is driven by actuators.

8. A method of removing an ink cassette of the thermal transfer printer according to claim 2, comprising the steps of:

(a) moving said first locomotion system to extract said head mounting base with said ink cassette mounted thereon for a predetermined distance so as to dissolve the engagement with a printer main body;

(b) after said step (a), spacing apart said head mounting base from said platen roller by said supporting system as said second locomotion system moves;

(c) after said step (b), extracting said ink cassette to the extending direction of said thermal head so as to remove from said head mounting base; and (d) after said step (c), further moving said first locomotion system and extracting said head mounting base to a position outside the printer main body.

* * * * *